United States Patent [19]

Sato

[11] 4,038,775

[45] Aug. 2, 1977

[54] DOLL BODY WITH MAGNET AND POLE PIECES AND DETACHABLE APPENDAGES

[75] Inventor: Yasuta Sato, Tokyo, Japan

[73] Assignee: Takara Co, Ltd., Tokyo, Japan

[21] Appl. No.: 584,851

[22] Filed: June 9, 1975

[30] Foreign Application Priority Data

Oct. 31, 1974 Japan ..... 49-132236[U]

[51] Int. Cl.[2] ..... A63H 33/26

[52] U.S. Cl. ..... 46/22; 46/241; 403/DIG. 1

[58] Field of Search ..... 46/22, 241, 236; 403/DIG. 1; 248/206 A

[56] References Cited

U.S. PATENT DOCUMENTS

| | | | |
|---|---|---|---|
| 2,963,167 | 12/1960 | Norman | 248/206 A X |
| 2,970,388 | 2/1961 | Yonkers | 46/241 UX |
| 3,041,697 | 7/1962 | Budreck | 46/241 UX |
| 3,068,615 | 12/1962 | Nassour | 46/241 |
| 3,090,155 | 5/1963 | Gordon | 46/22 |
| 3,375,604 | 4/1968 | Alonso | 46/22 |
| 3,419,832 | 12/1968 | Baermann | 248/206 A X |
| 3,827,021 | 7/1974 | Phelon | 248/206 A X |

FOREIGN PATENT DOCUMENTS

| | | | |
|---|---|---|---|
| 1,266,884 | 6/1961 | France | 403/DIG. 1 |
| 1,027,473 | 4/1958 | Germany | 403/DIG. 1 |
| 1,032,613 | 6/1958 | Germany | 403/DIG. 1 |
| 514,679 | 1955 | Italy | 46/22 |

*Primary Examiner*—F. Barry Shay

*Attorney, Agent, or Firm*—Harold L. Jackson; Stanley R. Jones; Joseph W. Price

[57] ABSTRACT

A doll is provided having a plurality of segments which are coupled operably but removably to each other. Each segment has a joint portion or portions which provide an articulation or a joint means in combination with a counterpart joint portion or portions of another segment, when assembled. The articulation or joint means comprises a magnet means built in one segment, and a counterpart joint portion of a magnetic material which is part of another segment. The magnet means comprises a permanent magnet and a pair of pole pieces formed with extension portions which provide magnetic gaps to the aforesaid counterpart portions of another segment, defining joint positions. The counterpart portion described is attracted to the aforesaid pair of pole pieces in the aforesaid joint position to allow for relative movement to the pole pieces.

4 Claims, 6 Drawing Figures

DOLL BODY WITH MAGNET AND POLE PIECES AND DETACHABLE APPENDAGES

BACKGROUND OF THE INVENTION

This invention relates to a magnetic joint for a doll and the like, and more particularly to a doll having joint means between each two of sgements representing a head, body, upper limbs or arms, and lower limbs or legs. The joint means being adapted to joint the same together operably but removably. Dolls are known, in which respective segments are movably coupled to each other by rubber cords, in an attempt to retain some of those segments in a desired pose. On the other hand, dolls are also known, in which there are prepared several sets of segments of different designs, so that some of these may be combined in any manner desired by the user. With the dolls of such a type, the segments forming such a doll should be coupled together removably, i.e., one segment should preferably move relative to another. For this purpose, a cavity is provided in one segment, while a joint means including a stem having a spherical end, which corresponds to a head of a bone, is provided for another segment. The joint means, however, should allow the stem to be removably held in the cavity in a manner that the stem may be free to move within the cavity and also fixed in position temporarily according to the friction prevailing between the stem and the wall of the cavity. For such a purpose, a relative elastic deformation between the stem and the wall of the cavity is utilized. Thus, the respective segments are made of a material, which provides a desired elastic deformation, such as soft synthetic resin or rubber. Apparently, the softer the material, the easier attachment of one segment to another. However, this suffers from a shortcoming in that, when one segment thus jointed is moved, there may not be achieved sufficient friction to maintain those segments in a desired pose. It follows from this fact, in the case of a joint means described, the material of those segments should provide a considerable toughness in addition to a desired softness, so that there is required a relatively greater force for coupling and removing those segments together and from each other. In case such a doll is intended to be played by a child, the aforesaid shortcoming should be eliminated.

It is accordingly an object of the present invention to provide a doll and the like in which a plurality of segments representing for example a head, body, arms and legs are provided with magnetic joints cooperative with each other, so that one segment may be operably but removably coupled to another with ease.

It is another object of the present invention to provide a doll having a magnetic joint means, which allows relative, universal movement of those segments but insures a temporary fixing of those segments in a given position within their movable range. For attaining those objects, the present invention provides a doll having a plurality of segments which are removably coupled together, said doll presenting joint means, in which one joint portion in one segment cooperates with another joint portion in another segment, said joint means including: magnet means which is provided in one segment and consists of a permanent magnet and a pair of pole pieces disposed on the opposite surfaces of the magnet, as viewed in the magnetizing direction; and a portion of another segment to be coupled to said one segment, said portion being made of a magnetic material. The aforesaid pair of pole pieces have extension portions which project outward of the permanent magnet, the extension portions each having joints of a shape matching with the spherical end of the aforesaid portion of another segment to be coupled. In this manner, the aforesaid spherical end is attracted to the extension portion in a removable but movable manner. The term "spherical end" includes an end which provides a spherical or arcuate surface, and thus the term should not be construed in a limitative sense. In addition, the aforesaid segment may represent a head, body, arm or leg of a doll, and may be a decoration of a doll, as the case may be. As can be well understood from the relation of a body to a head, arm or leg, several sub-segments are coupled to a major segment removably but operatively. In such a case, a single magnet means is provided for the major segment, while counterpart joint portion are provided for the sub-segment. In this case, the magnet means in the major segment provides joint positions for each of the sub-segments.

BRIEF DESCRIPTION OF THE DRAWINGS

These and other objects and features of the present invention will be apparent from a reading of the ensuing part of the specification in conjunction with the accompanying drawings, which indicate embodiments of the present invention, in which.

DESCRIPTION OF THE PREFERRED EMBODIMENTS

Figure 1:
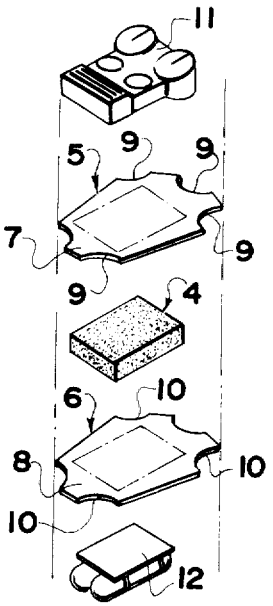
FIG. 1 is an exploded perspective view of a body of a doll.
Figure 3:
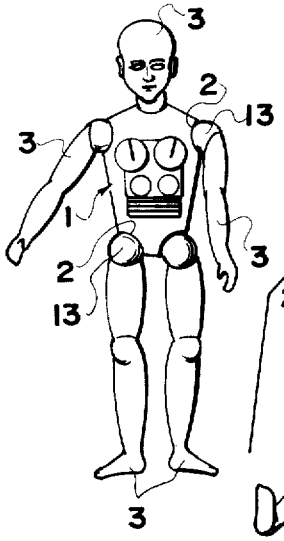
FIG. 3 is a front view of the doll according to the present invention.
Figure 2:
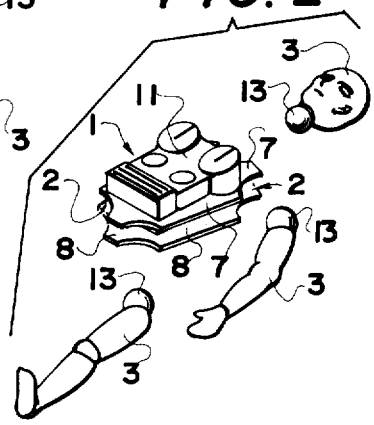
FIG. 2 is a perspective view of a body of a doll of FIG. 1, when assembled.
Figure 4:
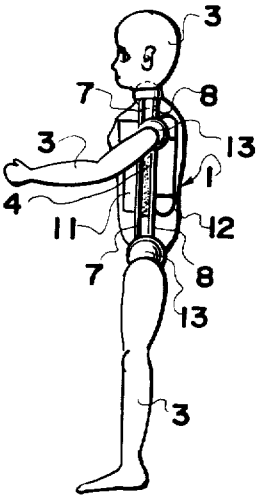
FIG. 4 is a side view of doll of FIG. 3.

Referring now to FIGS. 2 through FIG. 4, there are shown embodiments according to the present invention in the general form of dolls. A doll shown consists of a major segment 1 representing a body and a plurality of sub-segments 3 representing a head, arm and leg, which are to be coupled to the major segment 1 in several joint positions 2. The major and sub-segments 1 and 3, respectively, may be made of a magnetic material. However, the configurations of these segments should resemble the portions of a human body, which correspond thereto.

The major segment 1 is provided with a magnet means comprising a permanent magnet 4 and a pair of pole pieces 5, 6, which contact the opposite surfaces of the permanent magnet 4, as viewed in the magnetizing direction of the magnet 4. In this respect, the aforesaid pair of poles pieces 5, 6 are formed with extension portions 7, 8, which project outwards of the permanent magnet 4 and provided with cuts 9, 10 at its edges 7, 8, presenting joint positions 2. The joint positions 2 represent the portions of the major segment 1, such as "head", "shoulder" and "waist", respectively. In this instance, the major segment 1 is provided with a breast portion decoration 11 and a back portion decoration 12 which cover the pair of pole pieces 5, 6, respectively. In fabrication, a pair of pole pieces 5, 6 are bonded to the opposite sides of the magnet 4 and then the breast portion decoration 11 and back portion decoration 12 are bonded to the pair of pole pieces 5, 6, respectively. However, in case the major segment 1 is prepared by casting a resin into a mold, the permanent magnet 4 and pole pieces 5, 6 may be embedded in the major segment 1. In this respect, it is preferable to so arrange that the cuts 9, 10 defined in the pole pieces 5, 6 be exposed from the major segment, presenting the joint position 2.

Each of sub-segments 3 is formed with joint portions to be coupled, which is made of a magnetic material and has a spherical end. The spherical end of the portion 13 to be coupled is of such a size as to match with those of the cuts 9, 10 of a pair of the pole pieces 5, 6. Although not shown, the sub-segment 3 may be fastened to the joint portion 13 according to a known method, say, by using screws. Alternatively, an insert embedded in the joint portion 13 may be so designed as to be embedded in the sub-segment 3.

According to the present invention, there is provided a joint means, in which the permanent magnet 4 and pole pieces 5, 6 constituting a magnet means cooperate with the joint portions 13 of the sub-segment 3, which portions 13 are made of a magnetic material. The permanent magnet 4 may be a ferrite magnet. However, the magnetic fluxes are induced into a pair of the pole pieces 5, 6, presenting magnetic fields having a maximum magnetic flux density, between the extension portions 7, 8 of the pole pieces 5, 6. As a result, if the joint portion 13 made of a magnetic material is placed in the joint position 2 defined by the cuts 9, 10 of the extension portions 7, 8, then the joint portions 13 will undergo a strong magnetic force, thus being attracted thereto. This magnetic force permits the joining of the major segment 1 and sub-segment 3 in a desired pose and maintains same in position. Thus, the major segment 1 and sub-segment 13 may effect a universal movement relative to each other. In addition, if an external force overcoming the aforesaid magnetic force is applied, then the major segment 1 may be detached from the sub-segment 13. The aforesaid external force may be of energy of an instantaneous nature. At any rate, if there is created a small gap between the cuts 9, 10 of a pair of pole pieces 5, 6 and the joint portions 13, then one segment ,may readily be detached from another.

According to the present invention, the joint position 2 are defined by the cuts 9, 10 of a pair of the pole pieces 5, 6 which are bonded to the opposite surfaces of the permanent magnet 4, as viewed in the magnetizing direction. Such an arrangement may effectively utilize the magnetic fluxes and simplify the fabrication of the magnet means. In other words, as compared with the fabrication of a cast magnet of a special shape, which is formed with a joint portion having a spherical groove, it is much easier to make pole pieces 5, 6 of a desired shape from a magnetic material or to prepare the cuts 9, 10 therein However, there can be a problem when a joint number of joint position 2 which is defined by the cuts 9, 10 of a pair of pole pieces 5, 6, and the joint portion 13 are placed in the joint position 2 for coupling, the fluxes between the pole pieces 5, 6 will flow through the joint positions 13. This reduces the amount of available magnetic flux, which leads to the following shortcoming. In other words, in case a plurality of joint positions 2 are defined in the pole pieces 5, 6 at a small spacing, such as for instance, two joint positions are defined in the waiste portion of the major segment 1 for joining with the sub-segment 3, the joint portion 13 of a sub-segment in one of the two joint positions will bias the magnetic fluxes towards the joint portion 13, so that there may not be sufficient desired magnetic force for attracting another sub-segment in an adjacent joint position.

Figure 5:
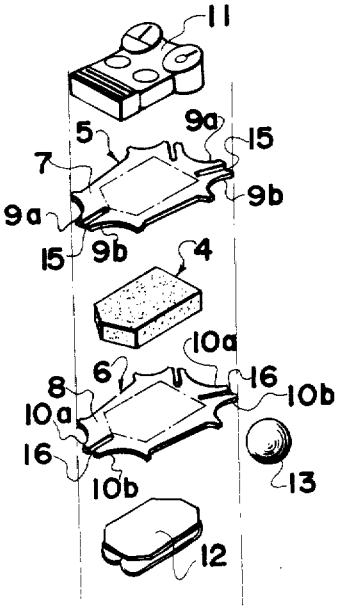
FIGS. 5 and 6 are exploded perspective views of a body of the doll according to the invention, whch is somewhat different from one shown in FIG. 1.
Figure 6:
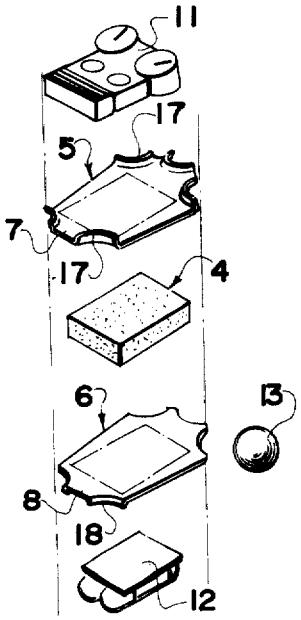

According to the present invention, the aforesaid shortcoming is overcome by the provision of slots 15, 16 defined in the pole pieces, as shown in FIG. 5, when the joint positions 2 are provided at a small spacing. The slots 15, 16 serve as magnetic resistances between the cuts *9a, 10a* and cuts *9b, 10b,* respectively This eliminates the biasing phenomenon of the magnetic fluxes which tend to flow through the first joint portion which is attached to the major segment.

On the other hand, according to the present invention, there are provided flanges 17, 18 which extend from the edges of the cuts 9, 10 of a pair of pole pieces 5, 6 along the spherical end surfaces of the joint portions 13, for the purpose of insuring the positive coupling of the joint portions 13. The above relation of the flanges 17, 18 resembles that of a bolt bearing. In this case, it is preferable that the area of the flange can receive half the surface of the joint portion 13, at the most. If the flanges 17, 18 are made of the same material as that of pole pieces 5, 6, there may be created a strong magnetic field between the flanges 17, 18 to cause the spherical end portion to be attracted to the major segment, while presenting an advantage that the flanges 17, 18 may minimize the unwanted floating movement of the spherical end portion 13, by receiving the latter positively.

What is claimed is:

1. In a toy doll having a magnetic joint structure, the improvement comprising:

a body member including a magnet, having at least two flat parallel surfaces, for producing magnetic flux;

a plurality of removable appendage members having respectively spherical magnetizable joint portions, said appendage members configured and positioned on the body member to represent respectively a head, legs and arms;

a first flat metal plate pole piece positioned on one parallel surface of said magnet and having a peripheral extension portion extending beyond said magnet;

a second flat metal plate pole piece positioned on said other parallel surface of said magnet and having an identical configuration to said first pole piece including a peripheral extension portion extending beyond said magnet, the first pole piece being spaced separate and apart from said second pole piece; and a plurality of joint means formed between said first and second pole pieces and including a plurality of respective complementary arc like edge configurations on each of said respective peripheral extension portions and spaced outwardly from and about said magnet to receive and removably secure the appendage members in general configurational positions to represent the nexus of the body member to said head, arms and legs, said appendage members being rotatably movable relative to the body member when retained by a respective joint means, said joint means being capable of contacting and transmitting magnetic flux to said spherical magnetizable joint portions of said appendage members while permitting relative movement therebetween.

2. The invention of claim 1 further including a body configuration surrounding said magnet and said first and second pole pieces.

3. The invention of claim 2 wherein said magnet has a rectangular configuration.

4. The invention of claim 1 further including a plastic housing member operatively attached to and about said pole pieces.

* * * * *